US007975388B2

(12) United States Patent
Fuchs et al.

(10) Patent No.: US 7,975,388 B2
(45) Date of Patent: Jul. 12, 2011

(54) HAND-HELD CIRCULAR SAW

(75) Inventors: Wolfgang Fuchs, Filderstadt (DE); Eduard Gansel, Dettenhausen (DE); Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 402 days.

(21) Appl. No.: 10/521,062

(22) PCT Filed: Jul. 25, 2003

(86) PCT No.: PCT/DE03/02510

§ 371 (c)(1),
(2), (4) Date: Jan. 12, 2005

(87) PCT Pub. No.: WO2004/060621

PCT Pub. Date: Jul. 22, 2004

(65) Prior Publication Data

US 2005/0217124 A1 Oct. 6, 2005

(30) Foreign Application Priority Data

Dec. 30, 2002 (DE) ..... 102 61 743

(51) Int. Cl.
*B27B 9/02* (2006.01)

(52) U.S. Cl. ..... 30/377; 30/388

(58) Field of Classification Search ..... 30/377, 30/390, 391, 388, 376; 83/13, 34, 56
See application file for complete search history.

(56) References Cited

U.S. PATENT DOCUMENTS

| | | | | |
|---|---|---|---|---|
| 1,792,204 | A | 2/1931 | Wallace et al. | |
| 1,900,553 | A * | 3/1933 | Hampton | 30/391 |
| 3,262,472 | A * | 7/1966 | McCarty et al. | 30/376 |
| 3,797,354 | A * | 3/1974 | Allison | 83/824 |
| 3,923,126 | A * | 12/1975 | Bidanset | 188/77 W |
| 3,982,616 | A * | 9/1976 | Bidanset | 192/104 C |
| 4,205,572 | A * | 6/1980 | Weiner | 83/666 |
| 4,856,394 | A * | 8/1989 | Clowers | 83/56 |
| 4,876,797 | A * | 10/1989 | Zapata | 30/388 |
| 4,881,438 | A * | 11/1989 | Pinney | 83/840 |
| 5,010,651 | A * | 4/1991 | Techter et al. | 303/76 |
| 5,074,179 | A * | 12/1991 | Omi | 83/478 |
| 5,570,511 | A * | 11/1996 | Reich et al. | 30/376 |
| 5,947,805 | A * | 9/1999 | Van Osenbruggen | 451/358 |
| 6,301,789 | B1 * | 10/2001 | Zeiler et al. | 30/388 |
| 6,301,790 | B1 | 10/2001 | Zeiler et al. | |
| 6,447,383 | B2 * | 9/2002 | Oda et al. | 451/357 |
| 6,898,854 | B2 * | 5/2005 | Zemlok et al. | 30/122 |
| 7,255,144 | B2 * | 8/2007 | Smith | 144/253.6 |
| 7,509,899 | B2 * | 3/2009 | Gass et al. | 83/62.1 |
| 2004/0159198 | A1 * | 8/2004 | Peot et al. | 83/62.1 |

FOREIGN PATENT DOCUMENTS

JP 59-167202 9/1984

* cited by examiner

*Primary Examiner* — Kenneth E. Peterson
(74) *Attorney, Agent, or Firm* — Michael J. Striker

(57) ABSTRACT

A circular power saw (10), composed of a saw assembly (12) with a housing (14, 16) that encloses a motor and a saw blade (18) capable of being driven by the motor, and that includes a handle, whereby the saw assembly (12) is pivotably supported relative to a footplate (22) such that it can be adjusted between a minimum and maximum cutting depth, is protected against kickback by the fact that, during sawing, the saw assembly (12) is decoupled from handling forces acting on the saw blade (18), in particular from the handle (24).

4 Claims, 5 Drawing Sheets

HAND-HELD CIRCULAR SAW

BACKGROUND INFORMATION

Figure 1:
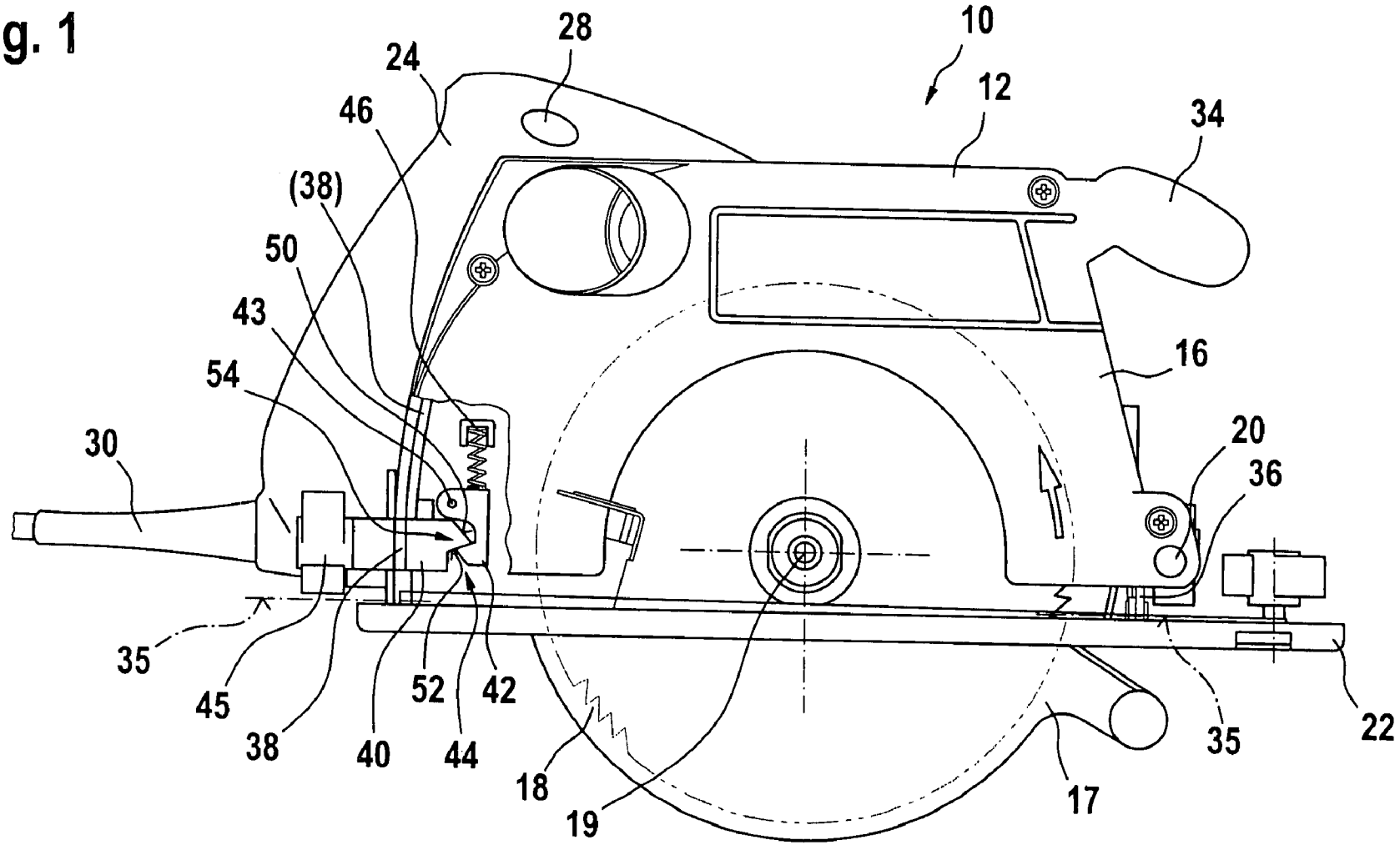

The present invention relates to a circular power saw.

Circular power saws are known that are configured either as plunge-cut saws or circular saws with pivoting protective hoods, e.g., according to U.S. Pat. No. 4,856,394, and which have the disadvantage that, if kickback occurs, they jump away from the work piece and can impact the operator in an uncontrolled manner, which can result in injury from the rotating saw blade extending downward past the footplate.

Kickbacks always occur with circular power saws when, during sawing, the side of the saw blade rotating from the top toward the bottom impacts the work piece with its sawteeth from above and/or catches in the cutting channel. As a result, the rotational energy of the saw blade and/or all rotating parts of the circular power saw is instantly converted to translational energy, so that the circular power saw is catapulted away from the work piece and/or at least rises up, thereby endangering the operator.

ADVANTAGES OF THE INVENTION

The present invention has the advantage that, if kickback occurs, the saw assembly with the saw blade is capable of being decoupled from the operator's handling forces, which, according to the related art, typically act on the saw blade. As a result, the translational impulse resulting from the instantaneously converted rotational energy from the saw blade remains smaller, because the saw assembly is first accelerated upward relative to the footplate, into its safety position. At the same time, the footplate of the circular power saw does not lift off of the work piece, and the pivoting protective hood closes. If the circular power saw jumps away from the work piece anyway, the saw blade no longer extends below the footplate and/or is covered by the pivoting protective hood. As a result, the operator is not endangered by the rotating saw blade.

Due to the fact that the circular power saw is capable of being handled and guided using only the handle, which is connected with the footplate in a fixed manner, the saw assembly is capable of being decoupled, in a simple manner, from the handling forces exerted by the operator.

Due to the fact that the saw assembly is pivotably detachable relative to the footplate via an overload coupling, then, if kickback occurs, it can get out of the way around the pivotal point of the cutting depth setting, whereby the saw assembly, with the saw blade, is accelerated into a position above the footplate, so that risk of injury by the saw blade is ruled out even when the footplate then lifts way from the work piece.

Due to the fact that, if kickback occurs, the saw assembly is capable of being locked in its safety position when it reaches this safety position, the situation is prevented in which the operator accidentally swivels the still-rotating saw blade below the footplate in the direction toward a greater cutting depth and is injured by it.

Due to the fact that the coupling is also releasable by hand, the circular power saw is capable of being placed conveniently and safely with the footplate on a surface without the pivoting protective hood resting on it.

DRAWING

The present invention is explained in greater detail with reference to an exemplary embodiment with associated drawing.

Figure 2:
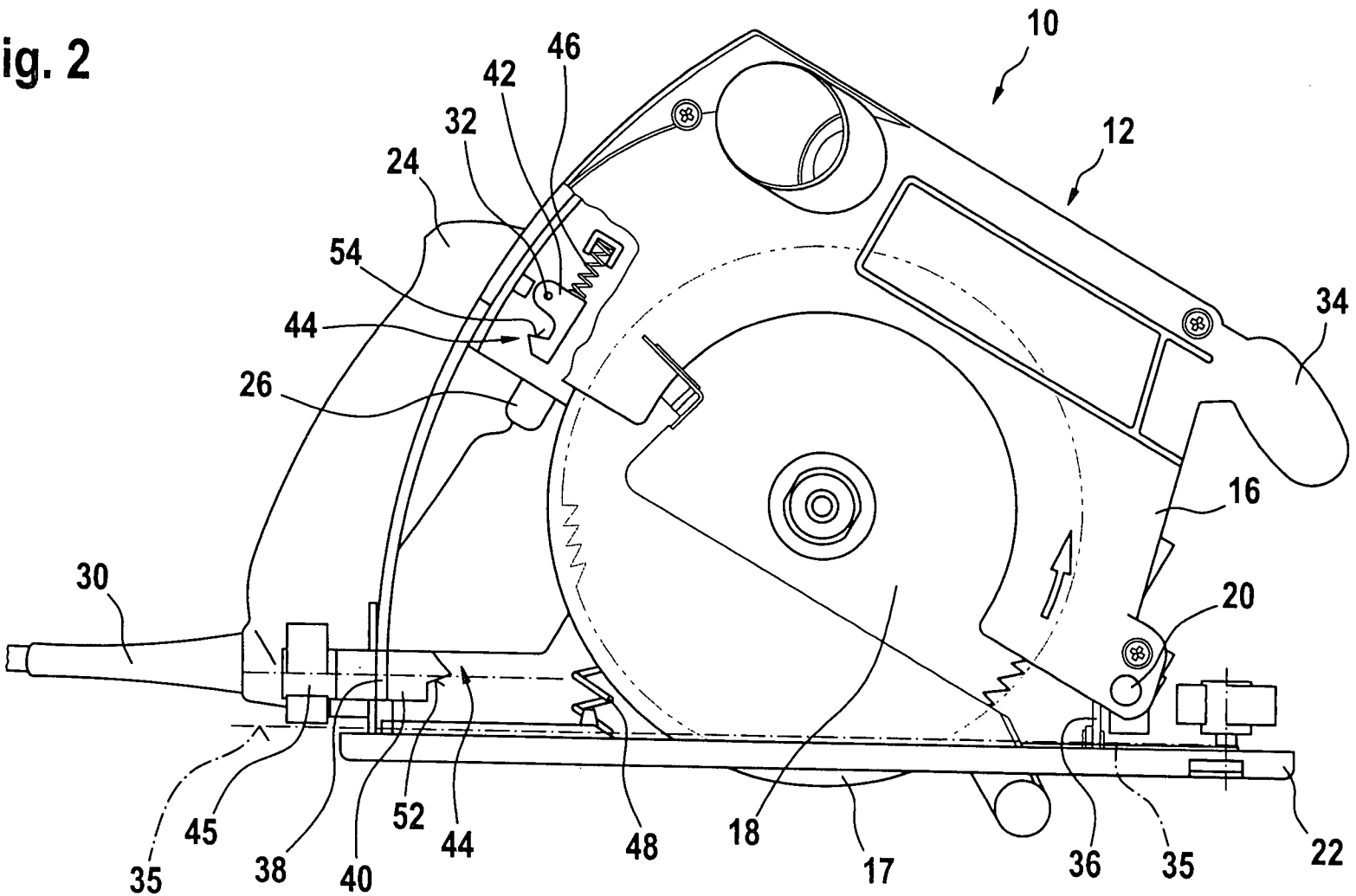
Figure 3:
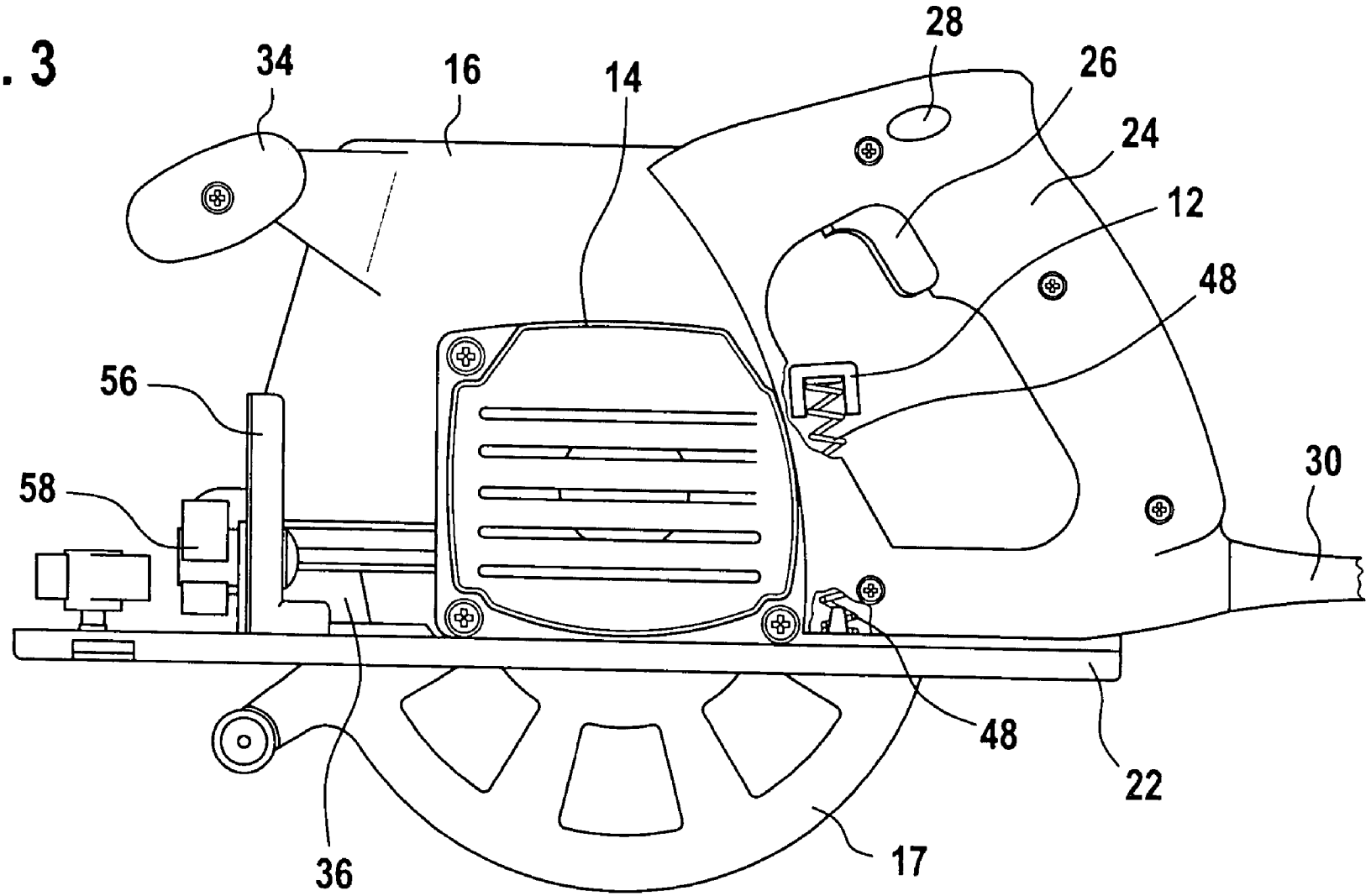
Figure 4:
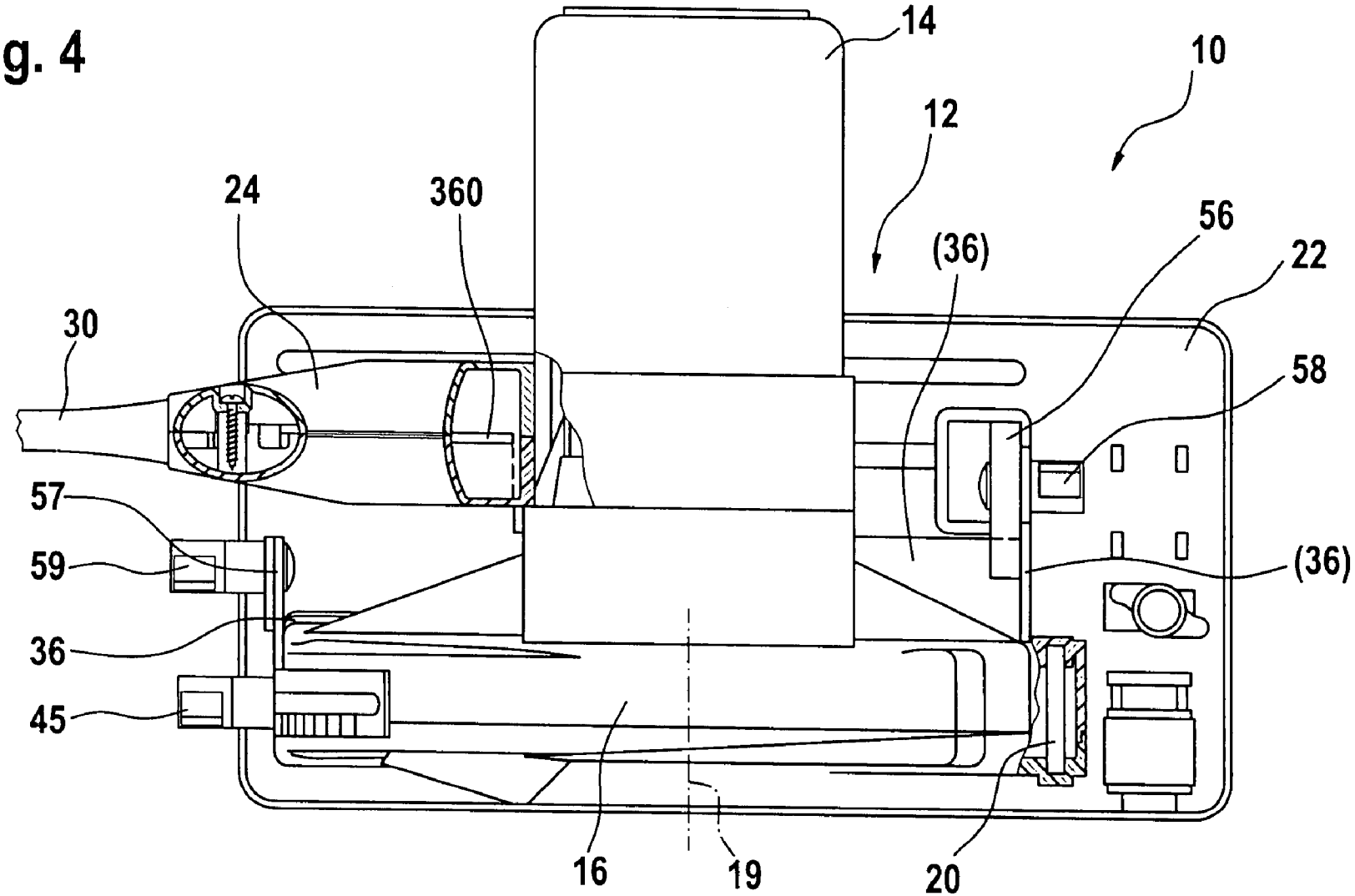
Figure 5:
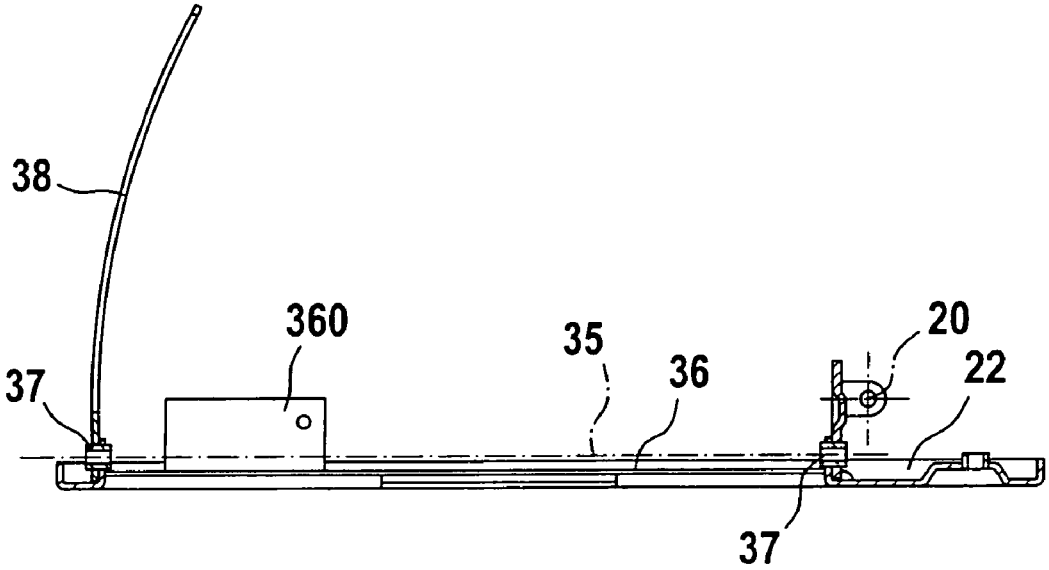
Figure 6:
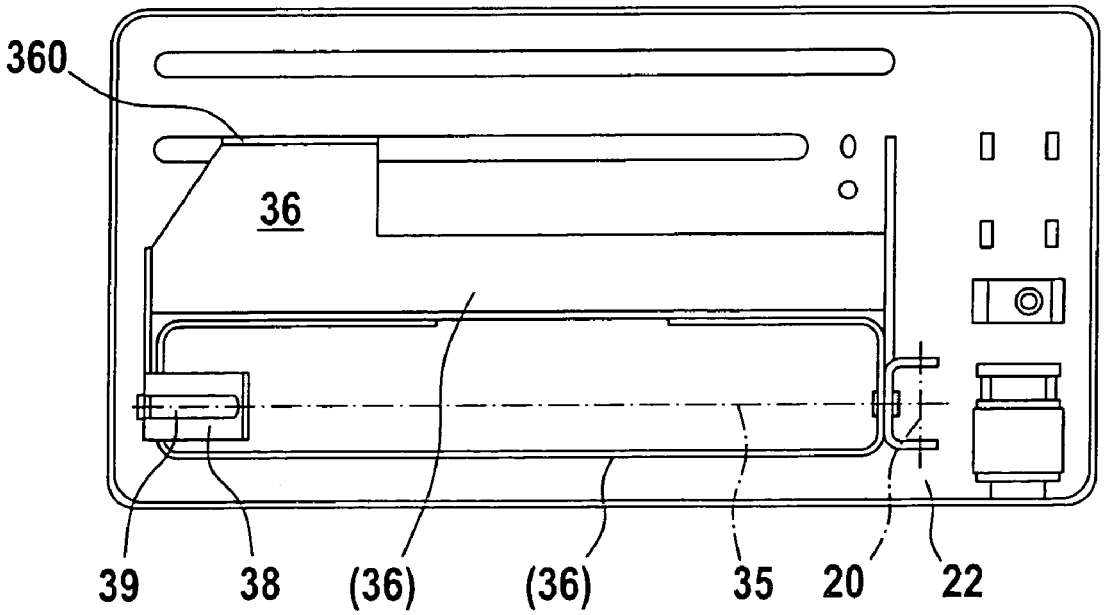

FIG. 1 shows a side view of the circular power saw according to the present invention, ready for sawing, with the coupling locked in place, as viewed from the right, FIG. 2 shows the side view according to FIG. 1 with the coupling released, FIG. 3 shows a side view of the circular power saw from the left, FIG. 4 shows a top view of the circular power saw, in a partially cut-out view, FIG. 5 shows a longitudinal sectional view of the footplate with swivel arm without saw assembly, and FIG. 6 shows a top view of the footplate according to FIG. 5.

EXEMPLARY EMBODIMENTS

FIG. 1 shows a side view of circular power saw 10 from the right, which is composed of a saw assembly 12 that is composed essentially of a motor housing 14 and a protective hood 16. The motor, which is accommodated in motor housing 14 and is not shown, serves to drive a saw blade 18, parts of which are enclosed by protective hood 16. Saw assembly 12 is supported by a footplate 22, which serves to provide safe placement on a not-shown work piece and simplifies sawing with a certain depth of cut, whereby saw blade 18 extends more or less far out from under footplate 22.

Saw assembly 12 is supported such that it is swivelable up and down relative to footplate 22 around a geometric axis 20 parallel to saw blade axis 19. A joint 20' which forms geometric axis 20 is supported by a swivel arm 36 which is pivotably supported relative to footplate 22 around an axis 35 that is perpendicular to saw blade axis 19, to set a mitre position of saw blade 18.

When saw assembly 12 has been swivelled downward around joint 20 to the maximum cutting depth, it impacts swivel arm 36. In this position, saw blade 18 has the maximum extension downward past footplate 22. To do this, the operator holds saw assembly 12 with one hand, e.g., on protective hood 16, and presses toward footplate 22. Detent coupling 44 latches in locking piece 40, the locking piece being locked in place in its lowest position using wing nut 45 in this illustration.

A handle 24 located behind protective hood 16 in the plane of the drawing in FIG. 1 is rigidly connected with swivel arm 36 and is not swivellable, together with the saw assembly, relative to footplate 22 for adjusting the depth of cut, as is the case with known circular power saws. Handle 24 includes a switch-like button 28 in the upper region for releasing a switch-on lock, with which a switching key 26 for switching on the saw assembly drive is lockable. Switching key 26 can be pressed down only when button 28 is pressed and held down.

A power cord 30 for supplying power to the saw assembly drive extends out of the back of handle 24. As seen on the right, i.e., at the front, protective hood 16 includes an additional handle 34, with which the operator can guide circular power saw 10 particularly safely with his second hand.

Saw assembly 12 is pivotably connected such that it is swivellable relative to footplate 22 with two degrees of freedom (FIGS. 5, 6), via joint 20 relative to swivel arm 36 and via swivel arm 36 itself. Swivel arm 36 is supported relative to footplate 22 using two swivel joints 37 that form a swivel axis 35 parallel to saw blade 18 and to footplate 22. Saw assembly 12 with swivel arm 36 is therefore supported for sawing mitre angles such that saw blade 18 is lockable in swivel positions between 90° to 45° relative to footplate 22. Swivel arm 36 can be adjusted in lockable, selectable swivel positions relative to footplate 22 using two pivoted links 56, 57 and associated pivoted lock-in mechanisms 58, 59.

Swivel arm 36 supports joint 20, around which saw assembly 12 is swivellably supported relative to footplate 22 to adjust the cutting depth. Joint 20 is located on the right, i.e., close to the front end face of footplate 22 of circular power saw 10, while, on the diametrically opposed side, i.e., at the rear, a cutting depth guide 38 is located on swivel arm 36, the cutting depth guide being configured as a sheet-metal strip curved around joint 20 in the manner of a circular arc, protective hood 16 being positioned on the sheet-metal strip such that it can be locked in place using locking piece 40 and/or wing nut 45. Cutting depth guide 38 includes a longitudinal slot (which is not described in greater detail), through which locking piece 40 and wing nut 45 grip, whereby locking piece 40 can be steplessly positioned in the longitudinal slot between a top end position and a bottom end position and fixed in place using wing nut 45.

In the top end position of locking piece 40, saw assembly 12 has been swivelled so far upward that saw blade 18 and pivoting protective hood 17 are located above footplate 22 such that they do not extend past it at the bottom.

A latching hook 42 is located on the protective hood in a rear region at a distance from saw blade 18, the latching hook being elastically coupled with protective hood 16 via a coupling spring 46. Latching hook 42 is swivellable in the manner of a pendulum around an axis 43 and grips with a latching flank 54 under a locking flank 52 of locking piece 40 when saw assembly 12 is swivelled far enough downward toward footplate 22. Latching hook 42 then glides across the front region of locking piece 40 in an overlatching manner, whereby latching flank 54 is held tightly under locking flank 52. To this end, the flank angles of locking flank and latching flank 52, 54 are selected such that, given a certain critical force that attempts to rotate saw assembly 12 upward around the joint, latching flank 54 can be released from locking flank 52, so that detent coupling 44 is opened and saw assembly 12 can be accelerated, by lift spring 48, into its upper end position. If a corresponding kickback occurs, saw assembly 12 is therefore accelerated upward without footplate 22 lifting away from work piece. Only when saw assembly 12 has reached its upper end position, in which saw blade 18 no longer extends downward past footplate 22, can footplate 18 follow the upward motion of saw assembly 12. Footplate 22 can lift away from the work piece and possibly even touch the operator without him being endangered by saw blade 18.

The release force of coupling 44 is defined by flank angles 52, 54 and the forces of springs 46 and 48, whereby coupling spring 46 tries to close detent coupling 44, but lift spring 48 tries to open detent coupling 44. In every cutting depth position, the closing force exerted by spring 46 on detent coupling 44 is greater than the opening force exerted by spring 48.

FIG. 2 shows circular power saw 10 shortly before the top end position of saw assembly 12 is reached. It is clearly shown that detent coupling 44 has been released, so that latching hook 42 is not engaged with locking piece 40, and saw assembly 12 is pressed into its upper end position via a lift spring 48.

The remaining features and reference numerals explained above for FIG. 1 will not be described here again.

FIG. 3 shows circular power saw 10 from the left side, whereby, unlike in FIGS. 1 and 2, lift spring 48 is shown particularly clearly, the lift spring trying to swivel saw assembly 12 upward relative to footplate 22 and/or relative to swivel arm 36.

Also shown particularly clearly and unlike in FIGS. 1 and 2 are front pivoted link 56 with front pivoted lock-in mechanism 58. Using pivoted link 56 and associated pivoted lock-in mechanism 58, the angular setting of saw assembly 12 and saw blade 18 relative to footplate 22 is lockably adjustable.

FIG. 4 shows a top view of circular power saw 10 according to the present invention, footplate 22 of which has rounded corner regions and on which the swivel arm 36 is capable of being swivelled and locked in place using pivoted links 56, 57 and/or pivoted lock-in mechanisms 58, 59. Swivel arm 36 includes an upwardly bent tab 360 with which handle 24 is rigidly connected. Swivel arm 36 can therefore be moved, using handle 24, into its angular position and/or mitre position together with saw assembly 12. Since swivel arm 36 includes joint 20, on which saw assembly 12 is supported such that it can be adjusted up and down, including a cutting depth setting, handle 24 is decoupled from saw assembly 12 during the up and down swivelling motion and is supported independently of it.

FIG. 5 shows a side view of footplate 22 without saw assembly 12 and handle 24, whereby swivel arm 36 with its swivel joints 37 is shown clearly and, therefore, so is its ability to be swiveled relative to footplate 22 and whereby the front, upwardly oriented region with joint 20 is shown as a rigid connecting piece with joint arm 36 and cutting depth guide 38 located at the rear as a rigid part of joint arm 36, and upwardly bent tab 360 as abutment of handle 24.

FIG. 6 shows a top view of FIG. 5, whereby swivel arm 36, cutting depth guide 38 with longitudinal slot 39 and a scale (not described in greater detail) with which the cutting depth can be adjusted in a controlled manner are shown.

In a further, not-shown exemplary embodiment of the present invention, detent coupling 44 is detachable by hand using a key or a button, thereby enabling a detent position to be reached more conveniently and quickly to deactivate the circular power saw.

In a further exemplary embodiment of the present invention, the top end position of saw assembly 12 is lockable in an overlatching manner relative to footplate 22 and releasable using the press of a button, as is common with plunge-cut saws. Since the saw according to the present invention includes a pivoting protective hood, however, this feature is optional and/or not absolutely necessary.

What is claimed is:

1. A circular power saw (10), comprising a saw assembly (12) with a housing (14, 16) that encloses a motor and a saw blade (18) configured to be driven by the motor;

a footplate (22), wherein the saw assembly (12) is pivotably supported on a swivel arm (36), wherein said saw assembly (12) is pivotable relative to the footplate (22) to be adjustable between a minimum and maximum cutting depth;

a handle (24) rigidly connected to the footplate (22) independently from the saw assembly (12), such that a back end of the saw assembly has no handle for gripping by a user of said power saw;

an overload coupling, wherein the saw assembly (12) is pivotably detachable relative to the footplate via the overload coupling, wherein said overload coupling is configured to fully decouple said saw assembly from an adjusted cutting depth automatically and instantaneously during sawing if kickback occurs, such that if kickback occurs, the saw assembly (12) accelerates upwardly without footplate (22) lifting away from a work piece and kicks into a position of minimum cutting depth relative to the footplate (22) and relative to the handle (24), whereby the handle remains in its prior position, said overload coupling comprising a detent piece (42) held against a locking piece (40) by a biasing force (46), said detent piece (42) disengaging from said locking piece (40) when a kickback force mechanically overcomes the biasing force (46).

2. The circular power saw as recited in claim 1, wherein the saw assembly (12) is supported on the swivel arm (36) such that the cutting depth is adjustable independently of the handle (24).

3. The circular power saw as recited in claim 1, wherein the locking piece (40) and the detent piece (42) have matching bearing surfaces (52, 54) that are con figured to bear against each other at a certain identical angle extending in the direction of the release force, whereby the angle is selected such that the locking piece (40) and the detent piece (42) automatically come apart when a certain minimum force is applied which moves the saw assembly (12) into the cutting depth position "0".

4. The circular power saw as recited in claim 1, further comprising a lift spring (48) to lift the saw assembly (12) away from the footplate (22) after the detent piece (42) has been disengaged from the locking piece (40) by the kickback force.

* * * * *